US006479775B2

(12) United States Patent
Shigetaka et al.

(10) Patent No.: US 6,479,775 B2
(45) Date of Patent: Nov. 12, 2002

(54) FLAT INPUT DEVICE HAVING PUSH SWITCHES

(75) Inventors: Hiroshi Shigetaka, Fukushima-ken (JP); Hidenobu Satoh, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/865,214

(22) Filed: May 24, 2001

(65) Prior Publication Data

US 2001/0049217 A1 Dec. 6, 2001

(30) Foreign Application Priority Data

May 31, 2000 (JP) ..... 2000-161848

(51) Int. Cl.[7] ..... H01H 9/00
(52) U.S. Cl. ..... 200/517; 200/5 A
(58) Field of Search ..... 200/5 R, 5 A, 200/17 R, 18, 512, 517, 600; 341/22; 345/173, 901; 400/472, 477, 479, 479.1; 434/317, 169

(56) References Cited

U.S. PATENT DOCUMENTS

| | | | | |
|---|---|---|---|---|
| 5,237,327 A | * | 8/1993 | Saitoh et al. | 200/5 A |
| 5,305,017 A | | 4/1994 | Gerpheide | 345/174 |
| 5,388,922 A | * | 2/1995 | Smiley | 200/5 A |
| 5,810,604 A | * | 9/1998 | Kopp et al. | 200/5 A |
| 6,365,848 B1 | * | 4/2002 | Maple | 200/5 A |

* cited by examiner

*Primary Examiner*—Michael Friedhofer
(74) *Attorney, Agent, or Firm*—Brinks Hofer Gilson & Lione

(57) ABSTRACT

A an inexpensive input device is formed having excellent operability. A step-wise gap is formed on a metallic basement, with a flat input member disposed on an upper stage and a filmy board on a lower stage. On the filmy board is disposed a push type input member, which is secured directly to the basement. At the step-wise gap of the basement is formed a through hole, in which a part of the filmy board is inserted. The inserted filmy board is connected to the flat input member and a computer.

10 Claims, 5 Drawing Sheets

FLAT INPUT DEVICE HAVING PUSH SWITCHES

BACKGROUND OF THE INVENTION

1. Field of the Invention

The present invention relates to input devices used for, e.g., coordinate input to personal computers, and more particularly to input devices including a combination of a flat input member and a push type input member.

2. Description of the Prior Art

FIG. 6 is a perspective view of a conventional input device.

The input device 60 is used incorporated in notebook size personal computers or the like, and includes a flat input member 61 and a push type input member 62 together.

The flat input member 61 comprises a printed wiring board 63, and a sensing element pad 64, on the printed board 63, through which coordinate data can be inputted. Furthermore, the printed wiring board 63 is formed integrally with an extension part 63*a*, which is a partial extension of the printed wiring board 63. Push switch elements 65 are mounted on the upper surface of the extension part 63*a*. On top of the push switch elements 65, operation buttons 66 are respectively placed at the cabinet side of a computer so that they can move vertically.

In the input device described above, operating the flat input member 61 enables input operations on a cursor displayed on a screen, and operating the push type input member 62 enables input (click) operations such as selection and decision of a menu displayed on the screen.

However, as shown in the conventional input device 60, placing the flat input member 61 and the push switch elements 65 of the push type input member 62 on the same printed wiring board 63 would require the printed wiring board 63 of a different shape for each of the models of computers. Also, since expensive multilayer boards have been generally used for the printed wiring board 63, it has been impossible to reduce costs.

Also, where the push switch elements 65 are disposed on the printed wiring board 63, it has been impossible to freely set the height of the operation face of the operation buttons 66 disposed on top of the push switch elements 65 and that of the operation face of the flat input member 61. Thus, mounting thick operation buttons 66 causes a great height difference between the operation face of the flat input member 61 and the operation face of the operation buttons 66, impairing operability.

Also, where the operation buttons are to be mounted directly on the printed wiring board 63, a reinforcing plate would be required to obtain a sufficient strength, causing a rise in costs.

SUMMARY OF THE INVENTION

The present invention has been made to solve the above described problems and provides an input device that can freely set a height difference between a flat input member and another input member without cost increase.

The present invention comprises: a basement; a flexible filmy board in part stuck onto the basement; a first operation member placed on the basement; and a second operation member that is placed on the filmy board and is connected to a conductive pattern on the filmy board, wherein the conductive pattern of a portion of the filmy board, not stuck to the basement, is connected to the first operation member.

For example, the first operation member is a flat input member. According to the present invention, the first operation member such as a flat input member is mounted on the basement. Because of this construction, a printed wiring board integrated with the first operation member need not be formed to a different shape for each model, as has been conventionally, and for example, a standard flat input member can also be mounted, enabling inexpensive manufacturing.

The second operation member is a push type input member, and for example, the push type input member may be constructed so as to include push switch elements mounted on the filmy board, and a supporter that supports operation buttons for activating the push switch elements and is secured to the basement.

By securing the supporter of the operation buttons for activating the switch elements mounted on the filmy board directly to the basement, the operation members can be supported so as to be operated without fail.

In this case, the push type input member may be a pair of push switch elements that output different signals between when one is pressed and when the other is pressed. By this construction, an image displayed on the screen can be vertically scrolled with simple operations.

The basement is preferably a metallic plate. A resinous board may be used if strength permits. By this construction, the operation buttons can be secured directly to the basement without providing a reinforcing plate or the like, preventing costs from rising.

A step-wise gap is formed on the metallic board, and it is desirable that the first operation member is formed on one stage and the filmy board is stuck to another stage, wherein the second operation member is mounted on the filmy board.

By the above construction, the height of the operation face of the first operation member and that of the operation face of the second operation member can be freely set. As a result, even if thick operation buttons are provided, operability would not be impaired, and the operation face of the first operation member and the operation face of the second operation member can be freely set to optimum heights.

In this case, a through hole or cutout is formed in the step-wise gap of the basement; the first operation member is formed on a higher stage and the filmy board is stuck onto a lower stage; a portion of the filmy board, not stuck onto the basement, extends to the back of the higher stage through the through hole or cutout; and the filmy board is connected to the back of the first operation member through a hole or cutout formed in the higher stage.

By this construction, as in conventional devices, a wiring board taken out from a connecting terminal of the first operation member can be omitted, contributing to a reduction in the number of parts and inexpensive manufacturing.

In the present invention, a portion of the filmy board can extend to the outside of the basement to form an outside connection part.

If the filmy board on which the second operation member is mounted is extended outside to form the outside connection part, the input device does not need to be provided with new connectors and leads for outside connection.

Furthermore, the filmy board is preferably a resinous film made of polyethylene terephthalate in which an Ag base paste is printed. This enables lower cost manufacturing in comparison with a filmy board on which a copper foil is formed on a polyimide film.

BRIEF DESCRIPTION OF THE DRAWINGS

Preferred embodiments of the present invention will be described in detail based on the followings, wherein:

FIG. 4 shows a filmy board;

DESCRIPTION OF THE PREFERRED EMBODIMENTS

Figure 1:
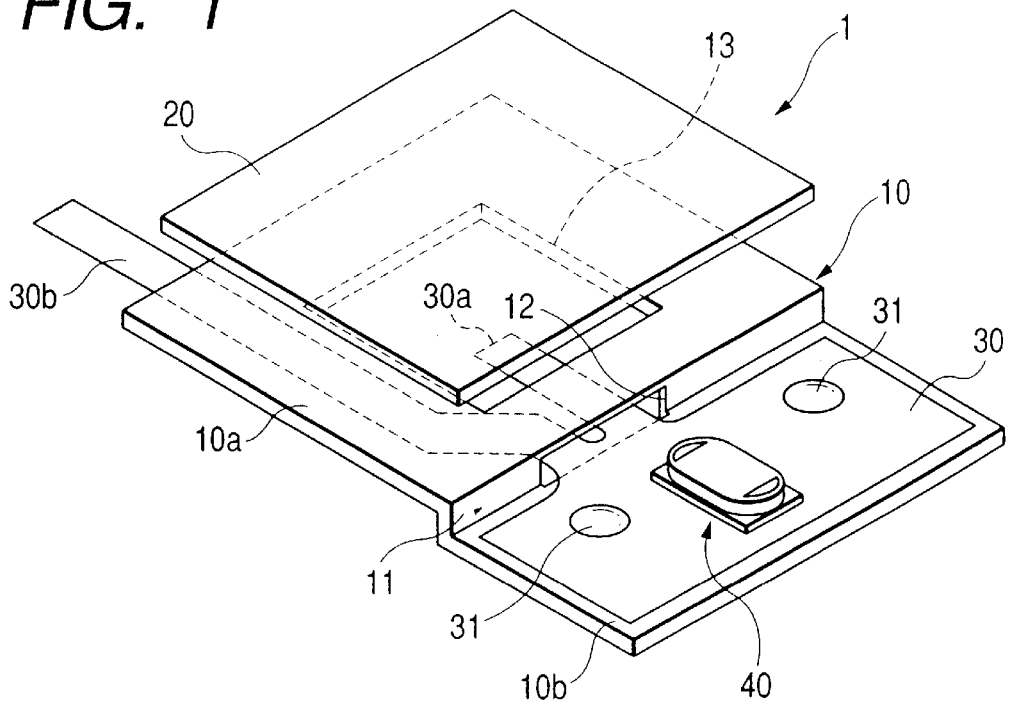
FIG. 1 is an exploded perspective view of an input device of the present invention.
Figure 2:
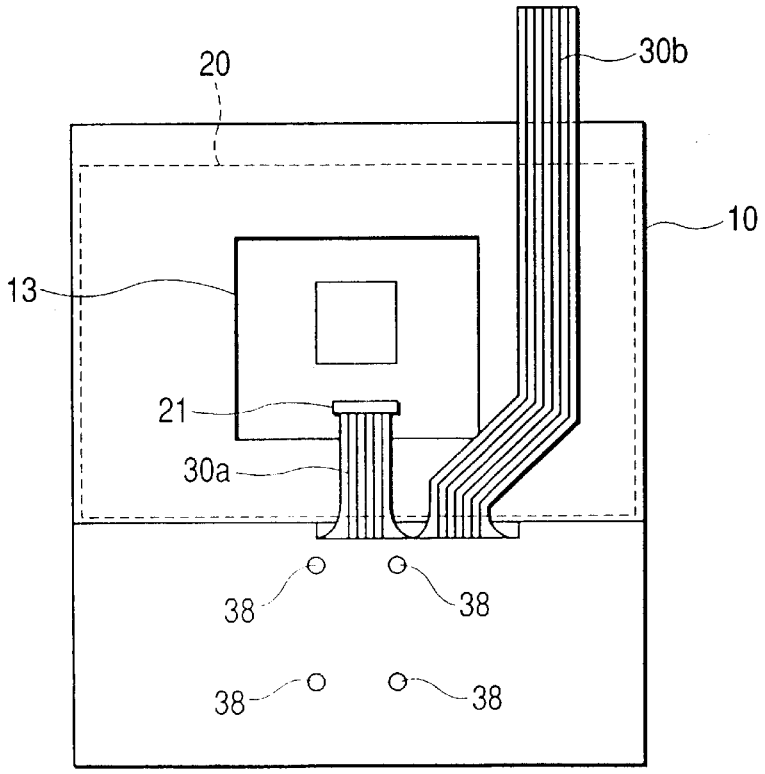
FIG. 2 is a back view of an input device of the present invention.

An input device 1 shown in FIGS. 1 to 5 is used as the operation part of a notebook size computer or the like and is placed in front of a keyboard. The input device may be formed singly so that it is connected externally of a main apparatus such as a desktop personal computer and the like, or may be incorporated integrally in other data input device such as a keyboard connected externally of the main apparatus.

The input device 1 comprises a basement 10, a flat input member 20 as a first operation member, a filmy board 30, and a push type input member 40 as a second operation member, which are incorporated in a personal computer as a unit for use. The push type input member 40 is mounted on the filmy board 30, on which push switch elements 31 are provided at each side of the push type input member 40. Switch output of the push switch elements 31 is switched by operation buttons supported at the cabinet side of the computer.

The basement 10, which is a metallic plate, is bent somewhere to form a step-wise gap 11. A through hole 12 is formed in the wall of the step-wise gap 11. A cutout part 13 is formed on an upper stage 10*a* of the basement 10.

As shown in FIG. 1, on the upper stage 10*a*, the flat input member 20 is mounted directly on the basement 10, which is a metallic plate, and is secured thereto by an adhesive, screwing, or other means. The filmy board 30 is stuck to a lower stage 10*b* of the basement 10 by an adhesive or the like. The flat input member 20, which is capacitive type in FIG. 5, may be either pressure sensitive type or a lamination of capacitive type and pressure-sensitive type.

Figure 5:
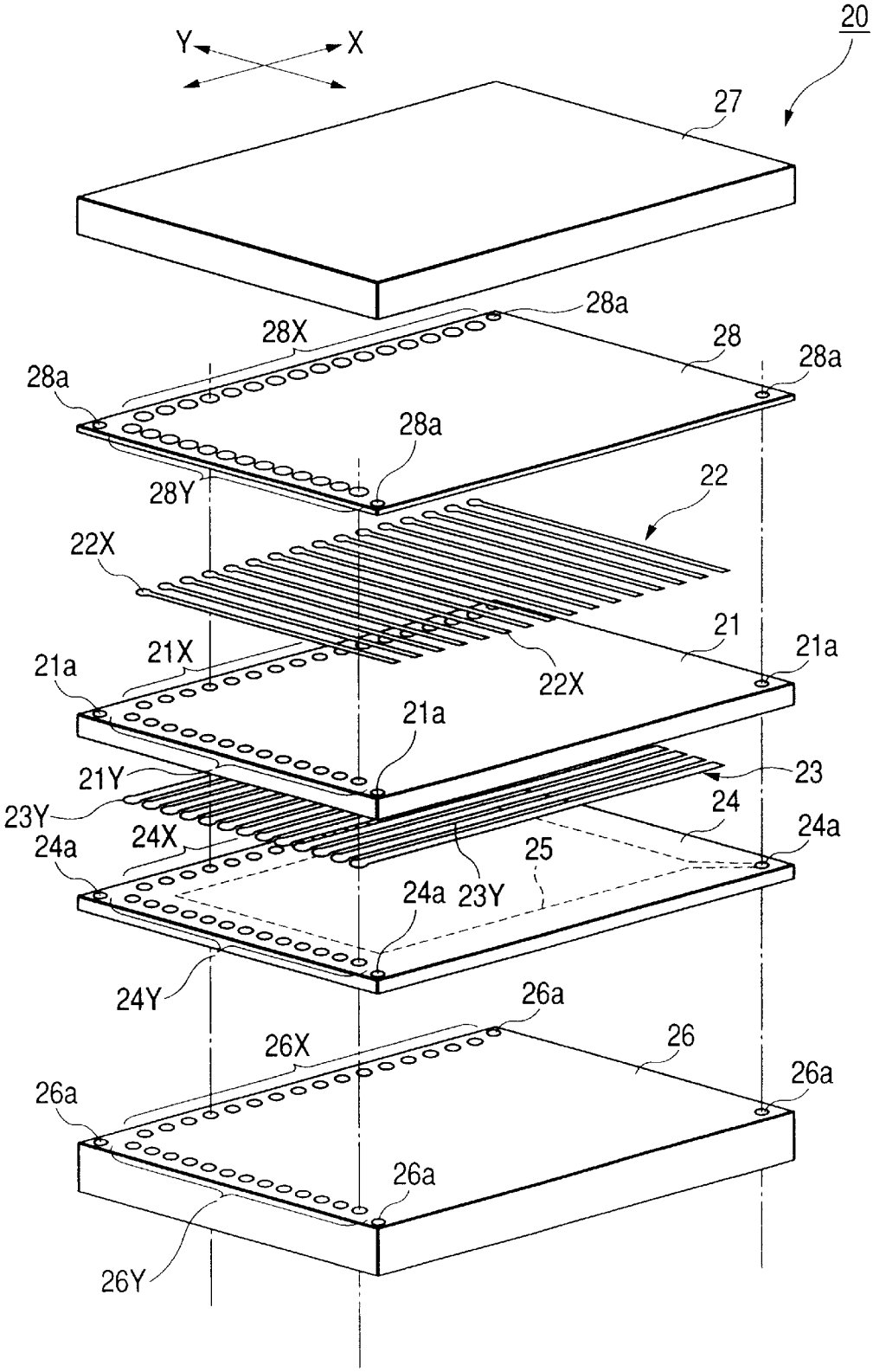
FIG. 5 is an exploded perspective view of a flat input member.
Figure 6:
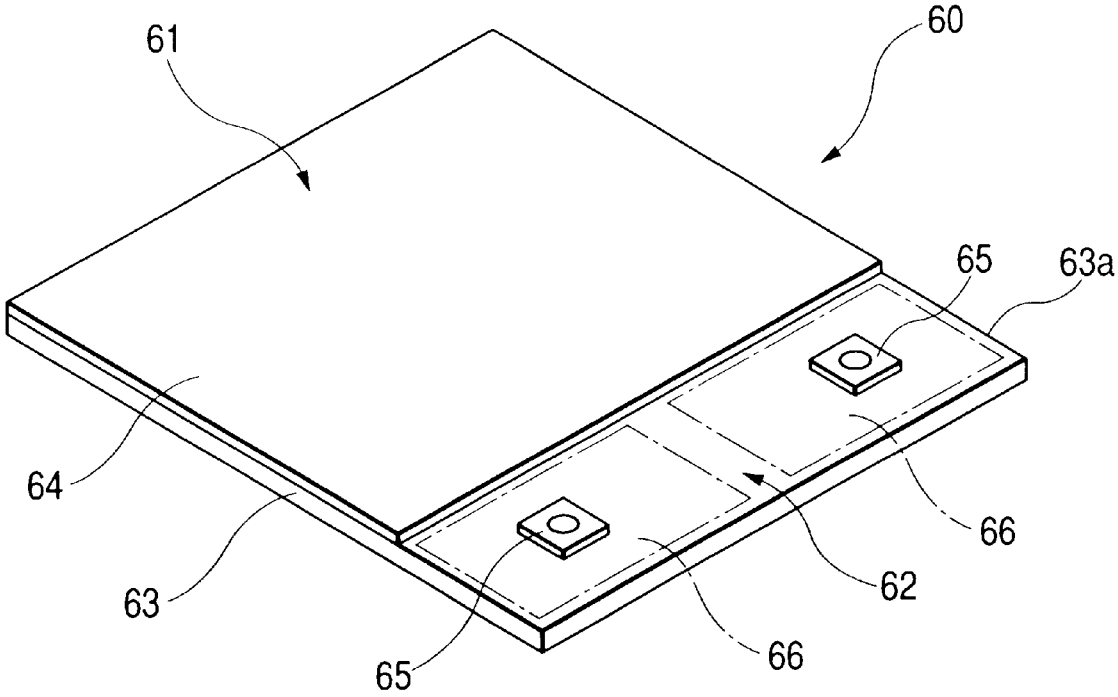
FIG. 6 PRIOR ART
FIG. 6 is a perspective view of a conventional input device.

As shown in FIG. 5, in the flat input member 20 of capacitive type, X-direction sensing electrodes 22X and Y-direction sensing electrodes 23Y which are made of Ag (silver) base paste are placed in a matrix form in opposed relation to each other, with a resinous sheet 21 sandwiched therebetween. A resinous sheet 21 is made of polyethylene terephthalate and the like, and has insulation properties and a predetermined dielectric constant.

A surface sheet 27 is stacked on the X-direction sensing electrodes 22X through a resist film 28. The surface of the surface sheet 27 may be covered with a coating so that a grain face is formed.

A resinous sheet 24 having insulation properties is provided on the part of the Y-direction sensing electrode 23Y, and a ground layer 25 is provided on the whole of a lower face of the resinous sheet 24 other than the marginal area thereof. On a lower face of the ground layer 25, a printed wiring board 26 made of a glass epoxy resin or the like is stacked, and a circuit pattern of copper foil is formed on a single face or double faces of the printed wiring board 26.

The surface sheet 27, resinous sheets 21 and 24, and printed wiring board 26 are identical or almost identical in the size of X-Y planes, so that only the printed wiring board 26 will not project outward. Therefore, standard parts of flat input members can be used.

At one side of the respective margins of the resinous sheets 21 and 24, the printed wiring board 26, and the resist film 28, plural through holes 21X, 24X, 26X, and 28X piercing from one face to another face are formed in line in the X-axis direction and stacked on top of one another. On another side, plural through holes 21Y, 24Y, 26Y, and 28Y piercing from one face to another face are formed in line in the Y-axis direction and stacked on top of one another. Furthermore, at the respective corners of the resinous sheets 21 and 24, the printed wiring board 26, and the resist film 28, ground-use through holes 21*a*, 24*a*, 26*a*, and 28*a* are respectively formed and stacked on top of one another.

The above described through holes 21X, 24X, 26X, 28X (21Y, 24Y, 26Y, 28Y), 21*a*, 24*a*, 26*a*, and 28*a* are charged with an Ag base paste as a conductive material 17. Thereby, the X-direction sensing electrodes 22X and the Y direction sensing electrodes 23Y are respectively connected with a circuit of the printed wiring board 26, and further the ground layer 25 is connected with the circuit of the printed wiring board 26 and is put at a ground potential.

A touch of a dielectric material such as a finger on the surface sheet 27 causes a change of capacitance between the X-direction sensing electrodes 22X and the Y-direction sensing electrodes 23Y at the touch position, enabling input from the X-Y coordinates.

The above described flat input member, without being limited to the above described construction, may be formed in a multilayer structure unlike the above described one or may be formed so as to be filmy throughout.

A pressure-sensitive flat input member includes a resistor to which a potential difference is applied in X and Y directions, and a conductive member facing the resistor. Pressing at any location brings the conductive member into contact with the resistor at that location and enables coordinate input because of a change of resistance values.

Figure 3:
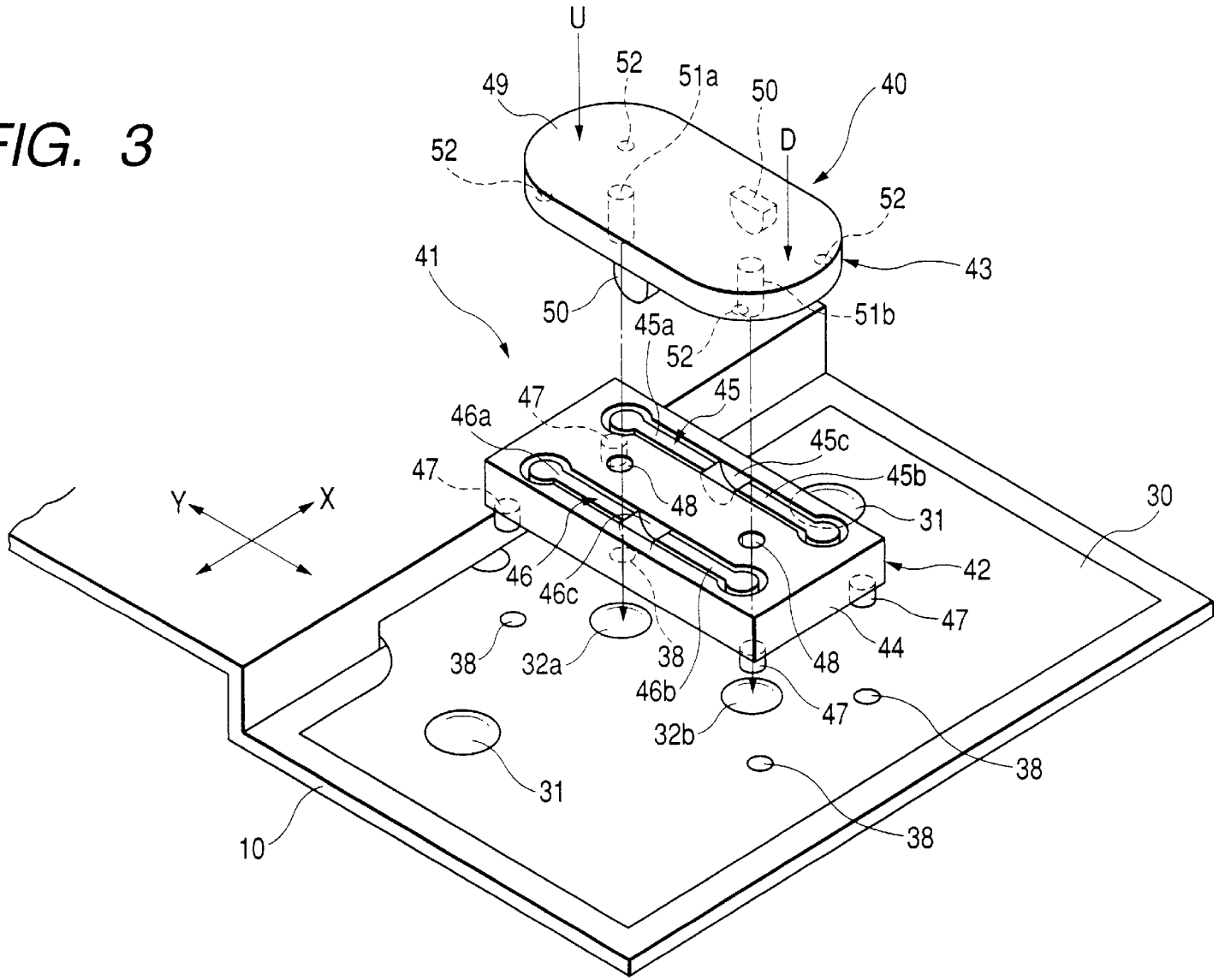
FIG. 3 is an exploded perspective view of a push type input member.

As shown in FIGS. 3 and 4, in the push-type input member 40, a pair of push switch elements 32*a* and 32*b* are disposed on top of the filmy board 30, and an operation button 41 is disposed on top of the push switch elements 32*a* and 32*b*. The push switch elements 32*a* and 32*b* are integrated with the filmy board 30 and connected to a conductive pattern on the filmy board 30.

The operation button 41 comprises a base member 42 and an operation member 43. The base member 42 is a supporter 44 made of a resin, formed in block shape. Within the supporter 44 are formed supporting members 45 and 46 extending lengthwise (Y direction) at each side of the lateral direction (X direction). The supporting members 45 and 46 are formed integrally with the supporter 44 at the center thereof, and supporting strips 45*a* and 45*b*, and 46*a* and 46*b* are respectively formed in notched form lengthwise from the center. Curved concave portions 45*c* and 46*c* are formed at the center of the supporting members 45 and 46. Therefore, the supporting strips 45*a* and 45*b*, and 46*a* and 46*b* are respectively resiliently deformable lengthwise.

At the corners of the bottom of the supporter 44, fixing projections 47, 47, 47, and 47 projecting downward are formed integrally with the supporter 44. The fixing projections 47 are inserted and secured in mounting holes 38, 38, 38, and 38 formed in the filmy board 30 and the basement 10.

Furthermore, insertion holes 48 and 48 are provided at a predetermined interval between the supporting strips 45*a* and 46*a*, and 45*b* and 46*b* of the supporter 44.

On the other hand, the operation member 43 is an elliptic operation member 49 made of a resin or the like. On the bottom of the operation member 49, as shown in FIG. 3, supporting projections 50 and 50, pressing projections 51*a* and 51*b*, and small projections 52, 52, 52, and 52 are formed.

The supporting projections 50 and 50 are semicircularly formed and inserted in the concave portions 45*c* and 46*c*. The pressing projections 51*a* and 51*b* are respectively inserted in the insertion holes 48 and 48, and the tips of the pressing projections 51*a* and 51*b* are freely projectable from the lower face of the supporter 44. The small projections 52 are adhesively secured to the tips of the supporting strips 45*a*, 45*b*, 46*a*, and 46*b*.

Although not shown, gaps are respectively formed between the operation member 49 and the supporter 44, and the supporter 44 and the filmy board 30. By the gaps, when the operation button 41 is pressed, the operation member 43 is pushed down, and further the supporting strips 45*a* and 46*a*, or the supporting strips 45*b* and 46*b* are pushed down, and at the same time the pressing projection 51*a* or 51*b* is pushed down.

Therefore, when the U side of the operation member 49 is pressed, the supporting strips 45*a* and 46*a* resiliently deform downward and the pressing projection 51*a* moves downward. At this time, by the pressing projection 51*a*, the push switch element 32*a* placed below it is pressed and switch output is switched on. When the pressing force is removed, the initial state is restored by resilient return force. Likewise, when the D side of the operation member 49 is pressed, switch output of the pressing switch element 32*b* is switched on.

As shown in FIG. 4, the push switch elements 32*a* and 32*b* are formed integrally with the filmy board 30, which is adhesively secured to a predetermined position of a lower stage 10*b* of the basement 10 through an adhesive layer 36.

Figure 4A:
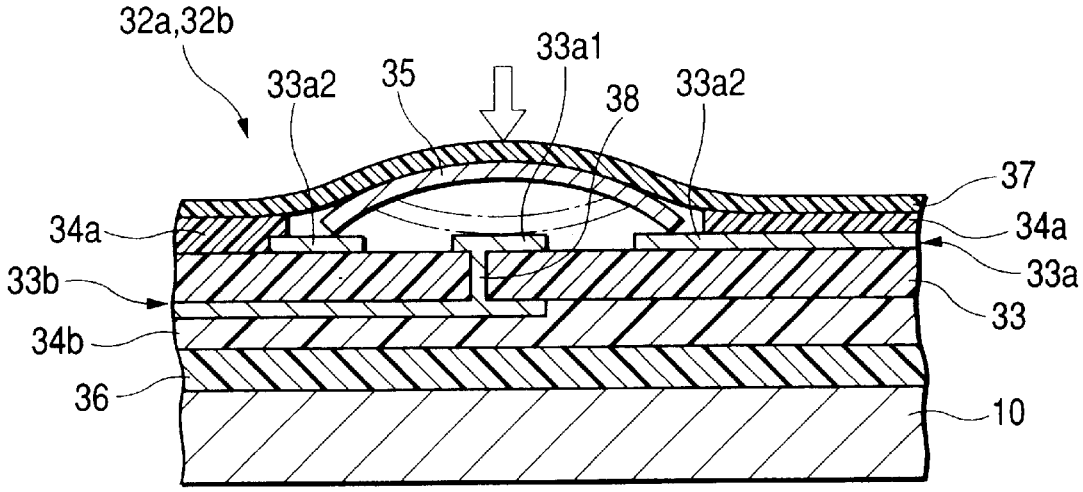
FIG. 4A is a sectional view and FIG. 4B is a plan view.
Figure 4B:
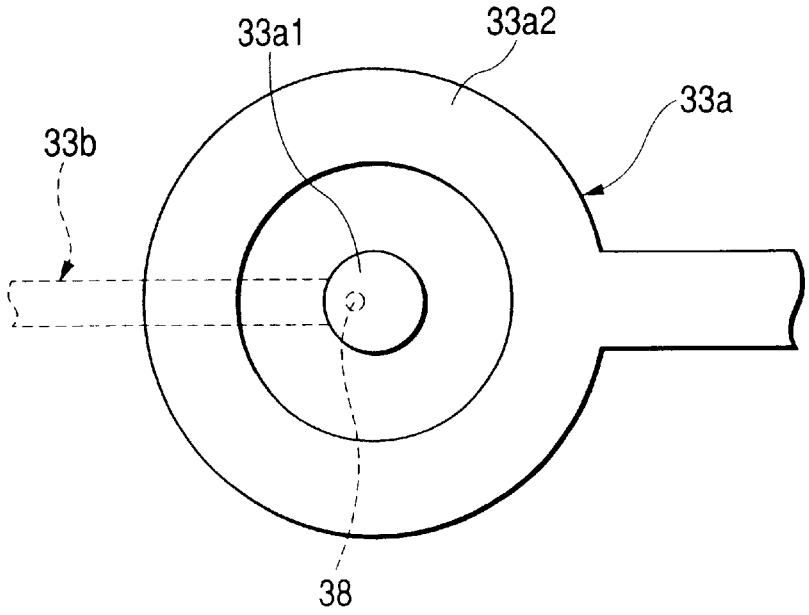

In the filmy board 30, as shown in FIGS. 4A and 4B, an electrode 33*a* and a conductive pattern 33*b* which are made of Ag base paste are patterned by printing or the like on both faces of a resinous sheet 33 made of PET (polyethylene terephthalate).

The electrode 33*a* is disposed on the upper face of the resinous sheet 33, and at the center thereof are formed a circular electrode 33*a*1 and a ring-shaped electrode 33*a*2, which is formed circumferentially about the electrode 33*a*1 and a predetermined interval off it, and the conductive pattern is formed continuously to a part of the electrode 33*a*2. On the lower face of the resinous sheet 33 is formed the conductive pattern 33*b*, which is connected with the electrode 33*a*1. A through hole is formed in the resinous sheet 33 on the lower face of the electrode 33*a*1, and a connecting conductor 38 for bringing the conductive pattern 33*b* and the electrode 33*a*1 into conduction is provided in the through hole. A domed (diaphragmatic) inversion plate 35 is disposed above the electrode 33*a*2 so that the circumferential portion of the inversion plate 35 abuts on the electrode 33*a*2 and the top of the inversion plate 35 and the electrode 33*a*1 are in alignment.

At the circumference of the inversion plate 35 and on the lower face of the conductive pattern 33*b* are respectively formed resist films 34*a* and 34*b*. Furthermore, the whole surface of the resist films are laminated by a resinous sheet made of PET.

The push switch elements 31 and 31 are also formed in the same was as described above. When the operation member 43 is operated by a finger, the pressing projection 51*a* or 51*b* goes down and the inversion plate 35 is pressed. The inversion plate 35 is inverted as indicated in a dashed line of the drawing and comes into contact with the electrode 33*a*1. Thereby, it is detected that the electrodes 33*a* and 33*b* are brought into conduction and switch output is switched on.

The filmy board 30 is formed integrally with a pullout board 30*a* connected with the flat input member 20 and an outside connection part 30*b* connected with a computer. The pullout board 30*a* and the outside connection part 30*b* of the filmy board 30 are not stuck to the basement 10 and are inserted in the through hole 12 so that the pullout board 30*a* is connected with the connecting terminal 21 provided on the back of the flat input member 20 through the above described cutout part 13, and the outside connection part 30*b* extends out of the basement 10 to be connectable with the computer.

In the input device 1 described above, for example, operating the flat input member 20 enables input operations such as movement of a cursor or the like displayed on a screen; operating the push-type input member 40 enables input operations such as vertically scrolling a display screen; and activating the push switch elements 31 and 31 enables click operations such as selection and decision of a menu displayed on a screen.

The input device of the present invention, without being limited to the above described embodiment, can be changed as required, in, e.g., the number and placement of push-type members. The push switch elements may employ tact switches without employing a domed inversion plate.

The present invention having been described above allows use of standard parts of the flat input device without changes and direct securing of the operation button without providing a reinforcing plate. By forming a step-wise gap in a basement, the height of the operation face of the first operation member and the height of the operation face of the second operation member can be freely set. Furthermore, connection wirings between the operation switch elements and the computer can be shared to reduce the number of parts. Therefore, the flat input device of the present invention can be manufactured inexpensively.

What is claimed is:

1. An input device, comprising:

a basement;

a flexible filmy board in part stuck onto the basement;

a first operation member placed on the basement; and a second operation member that is placed on the filmy board and is connected to a conductive pattern on the filmy board, wherein the conductive pattern of a portion of the filmy board, not stuck to the basement, is connected to the first operation member.

2. The input device according to claim 1, wherein the first operation member is a flat input member.

3. The input device according to claim 1, wherein the second operation member is a push type input member.

4. The input device according to claim 3, wherein the push type input member includes push switch elements mounted on the filmy board, and a supporter that supports operation buttons to activate the push switch elements and is secured to the basement.

5. The input device according to claim 4, wherein the push type input member includes a pair of push switch elements that output different signals between when one of the push switch elements is pressed and when the other of the push switch elements is pressed.

6. The input device according to claim 1, wherein the basement is a metallic plate.

7. The input device according to claim 6, wherein a step-wise gap is formed on the metallic plate, with the first operation member formed on one stage of the basement and the filmy board stuck to another stage of the basement, wherein the second operation member is mounted on the filmy board.

8. The input device according to claim 7, wherein:

a through hole is formed in the step-wise gap of the basement;

the first operation member is formed on a higher stage of the basement and the filmy board is stuck onto a lower stage of the basement;

a portion of the filmy board, not stuck onto the basement, extends to a back of the higher stage of the basement through the through hole; and the filmy board is connected to a back of the first operation member through a hole formed in the higher stage.

9. The input device according to claim 1, wherein a portion of the filmy board is extendable to an outside of the basement to form an outside connection part.

10. The input device according to claim 1, wherein the filmy board is a resinous film made of polyethylene terephthalate in which an Ag base paste is printed.

* * * * *

UNITED STATES PATENT AND TRADEMARK OFFICE

CERTIFICATE OF CORRECTION

PATENT NO. : 6,479,775 B2
APPLICATION NO. : 09/865214
DATED : November 12, 2002
INVENTOR(S) : Hiroshi Shigetaka et al.

It is certified that error appears in the above-identified patent and that said Letters Patent is hereby corrected as shown below:

On the Title Page

In column 2, line 1, under "ABSTRACT", delete "A an inexpensive input device is formed having" and substitute --The present invention provides an inexpensive input device having-- in its place.

Signed and Sealed this

Fifth Day of December, 2006

JON W. DUDAS
*Director of the United States Patent and Trademark Office*